United States Patent [19]

Johnson et al.

[11] 4,033,236

[45] July 5, 1977

[54] ALL HYDRAULIC MOTOR GRADER CIRCUITRY

[75] Inventors: Howard L. Johnson; John A. Junck, both of Joliet, Ill.

[73] Assignee: Caterpillar Tractor Co., Peoria, Ill.

[22] Filed: Feb. 4, 1974

[21] Appl. No.: 652,939

Related U.S. Application Data

[63] Continuation of Ser. No. 212,184, Dec. 27, 1971, abandoned.

[52] U.S. Cl. ..... 91/463; 137/596.18; 60/445

[51] Int. Cl.[2] ..... F15B 11/08; F15B 13/04

[58] Field of Search ..... 91/418, 444, 462, 463; 137/596.18; 60/445

[56] References Cited

UNITED STATES PATENTS

| | | | |
|---|---|---|---|
| 1,964,196 | 6/1934 | Cuttat | 91/421 |
| 2,157,707 | 5/1939 | Keel | 60/461 X |
| 2,240,898 | 5/1941 | Weidmann | 60/382 |
| 2,710,628 | 6/1955 | Hodgson | 91/421 X |
| 2,857,886 | 10/1958 | Williams et al. | 91/420 |
| 2,974,637 | 3/1961 | Holmes et al. | 91/443 X |
| 2,995,141 | 8/1961 | Hipp | 137/101 |
| 3,099,135 | 7/1963 | Hoadley | 91/443 X |
| 3,106,938 | 10/1963 | Gordon | 91/443 X |
| 3,186,307 | 6/1965 | Ellenbogen | 91/443 X |
| 3,198,088 | 8/1965 | Johnson et al. | 91/420 |
| 3,379,133 | 4/1968 | McCormick | 60/444 X |
| 3,685,531 | 8/1972 | Byford | 91/421 X |

FOREIGN PATENTS OR APPLICATIONS

| | | | |
|---|---|---|---|
| 786,189 | 6/1935 | France | 91/421 |

*Primary Examiner*—Edgar W. Geoghegan
*Attorney, Agent, or Firm*—Phillips, Moore, Weissenberger, Lempio & Majestic

[57] ABSTRACT

A closed center control valve for double acting motors having an inlet passage and a pair of control passages is provided with pre-sized restrictions in the control passages to control the flow rate to the motor so that a pre-selected velocity of movement of the motor is achieved.

9 Claims, 4 Drawing Figures

INVENTORS
HOWARD L. JOHNSON
JOHN A. JUNCK

BY
Fryer, Tjensvold, Feix, Phillips & Lempio
ATTORNEYS

INVENTORS
HOWARD L. JOHNSON
JOHN A. JUNCK

Fryer, Tjensvold, Feix, Phillips & Lempio
ATTORNEYS

INVENTORS
HOWARD L. JOHNSON
JOHN A. JUNCK

BY
Fryer, Tjensvold, Feix, Phillips & Lempio
ATTORNEYS

ALL HYDRAULIC MOTOR GRADER CIRCUITRY

This is a continuation of application Ser. No. 212,184, filed Dec. 27, 1971, now abandoned.

BACKGROUND OF THE INVENTION

The present invention relates to valves and pertains more particularly to closed centered pressure compensating control valves.

Some hydraulic machines have implements and systems which must undergo frequent adjustment to various fixed positions where they remain fixed for periods of operation. In other words, the hydraulic system is primarily for adjustment of machine implements rather than operation thereof. One example of such machines is a motor grander. Present motor graders normally employ open centered circuits with a pump delivering a constant flow of fluid at all times.

Considerable horsepower could be saved in such machines if pump flow could be reduced or cut back during periods when the control valves are in neutral.

Open centered circuits also have the disadvantage of being more sluggish and less responsive than closed centered systems.

Such vehicles also employ a number of different circuits having different flow requirements. These circuits are normally controlled from a bank of four or five valves. Because of the different flow requirements, the valves are sometimes quite different in size and construction.

SUMMARY OF THE INVENTION

It is the primary object of the present invention to provide a closed centered control valve that overcomes the above noted problems of the prior art.

Another object of this invention is to provide a valve that is adaptable with slight modification to a number of different flow rates.

A further object of the present invention is to provide a control valve that is operative to proportion the flow of fluid to the head end and the rod end of a double acting hydraulic motor so that the velocity of movement in either direction will be the same.

A still further object of the present invention is to provide a control valve adaptable in conjunction with a pressure compensated pump to provide positive and efficient control of hydraulically operated systems.

Still another object of the present invention is to provide a closed center valve system having means defining an effective orifice to match flow rate through a valve to a desired motor velocity.

In accordance with the primary aspect of the present invention, a closed center valve is provided with flow restricting means and pressure compensating means to provide a desired flow rate to a fluid motor.

BRIEF DESCRIPTION OF THE DRAWINGS

The above and other objects and advantages of the present invention will become apparent from the following description when read in conjunction with the accompanying drawings wherein.

DETAILED DESCRIPTION OF PREFERRED EMBODIMENT

Figure 2:
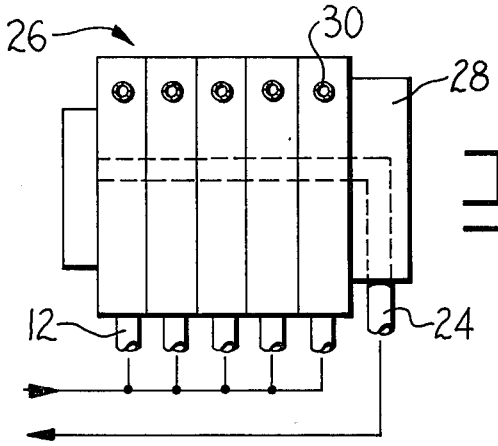
FIG. 2 is a schematic view of a bank of valves incorporating the present invention.
Figure 1:
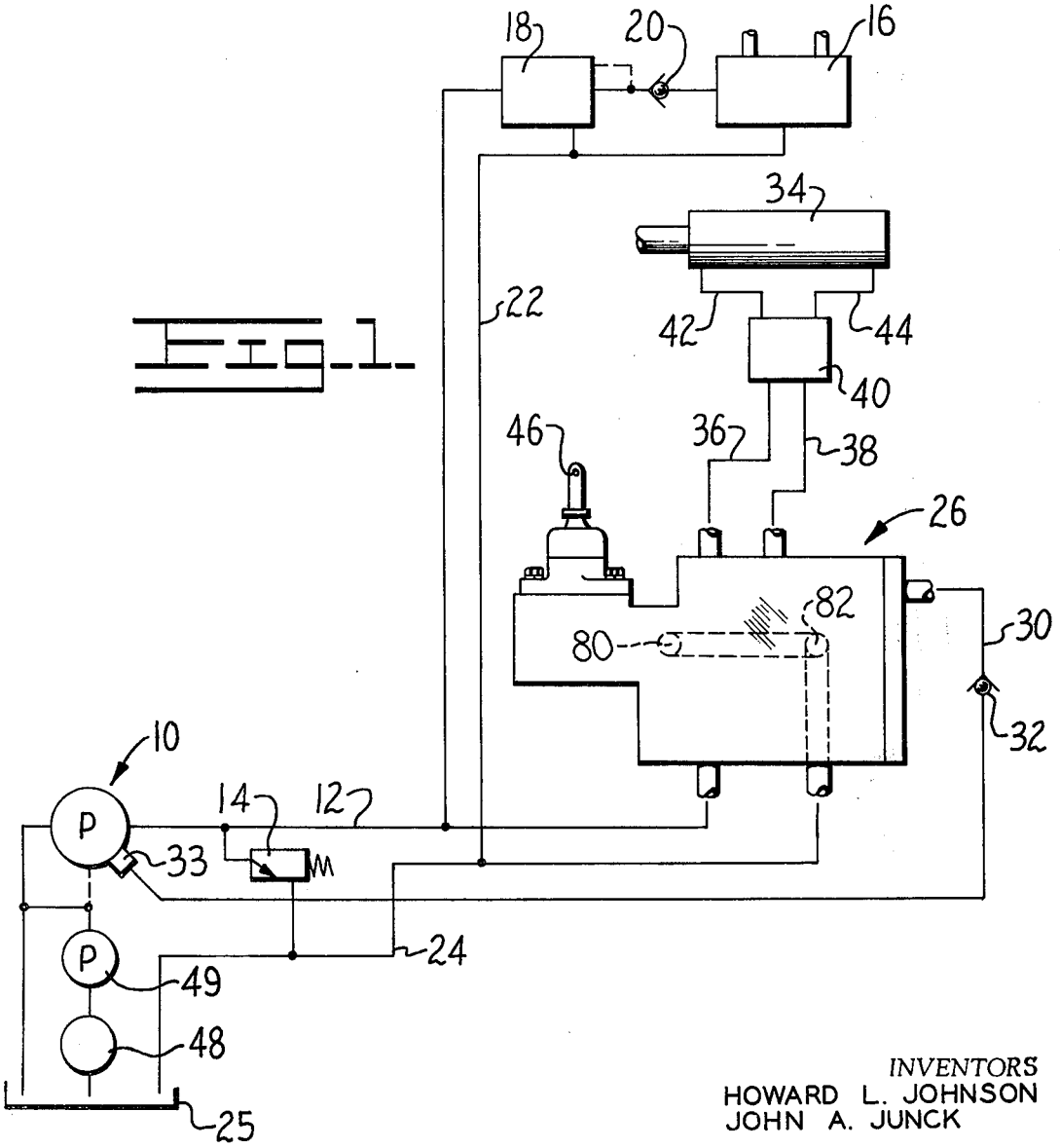
FIG. 1 is a schematic layout of a hydraulic system incorporating the present invention.

Referring now to the drawings, there is illustrated in FIG. 1 a schematic of a portion of a motor grader circuit embodied in the present invention. The illustrated circuit comprises a variable displacement pump 10 which supplies pressurized fluid to a number of different control valves by way of a conduit 12. A relief valve 14 is provided for controlling the maximum pressure in the supply line 12. The supply line 12 is operative to communicate fluid from the pump 10 to numerous control valves including a steering valve 16 for steering the vehicle. A pressure reducing valve 18 is interposed in the supply line branch between the supply and valve 16, and a check valve 20 is provided to prevent wheel kickback by preventing a backflow of oil out of the hand driven metering units of the steering system. A return line or conduit 22 is provided for returning fluid from the valves 16 and 18 to the reservoir 25. The line or conduit 12 supplies pressurized fluid to a control valve 26, a plurality of which are arranged in banks as shown in FIG. 2. The bank of control valves communicate by means of a manifold 28 with a common return line 24.

Referring back to FIG. 1, the valve 26 is communicated by means of a line 30 having a check valve 32 with pressure compensating means 33 of the variable displacement pump 10.

The pressure compensating means 33 for variable displacement pump 10 may be of any suitable construction such as that disclosed in U.S. Pat. No. 3,379,133 issued Apr. 23, 1968 to W. T. McCormick and assigned to the assignee of the present invention. Other suitable contruction may be of the novel type disclosed in either one of co-pending applications Ser. No. 157,157, now U.S. Pat. No. 3,738,779, filed June 28, 1971 entitled Pressure Compensator Means for a Variable Displacement Pump, or Ser. No. 157,535, now abandoned, filed June 28, 1971 entitled Pressure Compensator Control for Variable Displacement Pump, both by Hein et al, and assigned to the assignee of the present invention.

The check valve 32 operates to allow the pressure signal of highest level from any of several control valves to pass on through to means 33 to prevent pressure from other control valves for influencing the pressure compensating feature of a particular control valve. The control valve 26 is operative to control the operation of an implement motor 34 by means of a pair of control lines 36 and 38 connected through lock valve 40 with control lines 42 and 44. The lock valve 40 may be of any suitable construction such as that shown in U.S. Pat. No. 3,198,088, issued Aug. 3, 1965 to H. L. Johnson, et al. A control lever 46 is pivotally supported in the housing of valve 26 and operatively connected for manipulating the main control spool of the valve.

Because of the closed center system, a cooling system comprising a cooler 48 and a pump 49 are provided for cooling the oil by maintaining circulation thereof through the cooler 48. This is necessary because the closed center system maintains only enough flow in the system lines during neutral position to make up system leakage. Because of this low flow at this particular time, the cooling system is necessary to prevent excessive temperature buildup.

Figure 3:
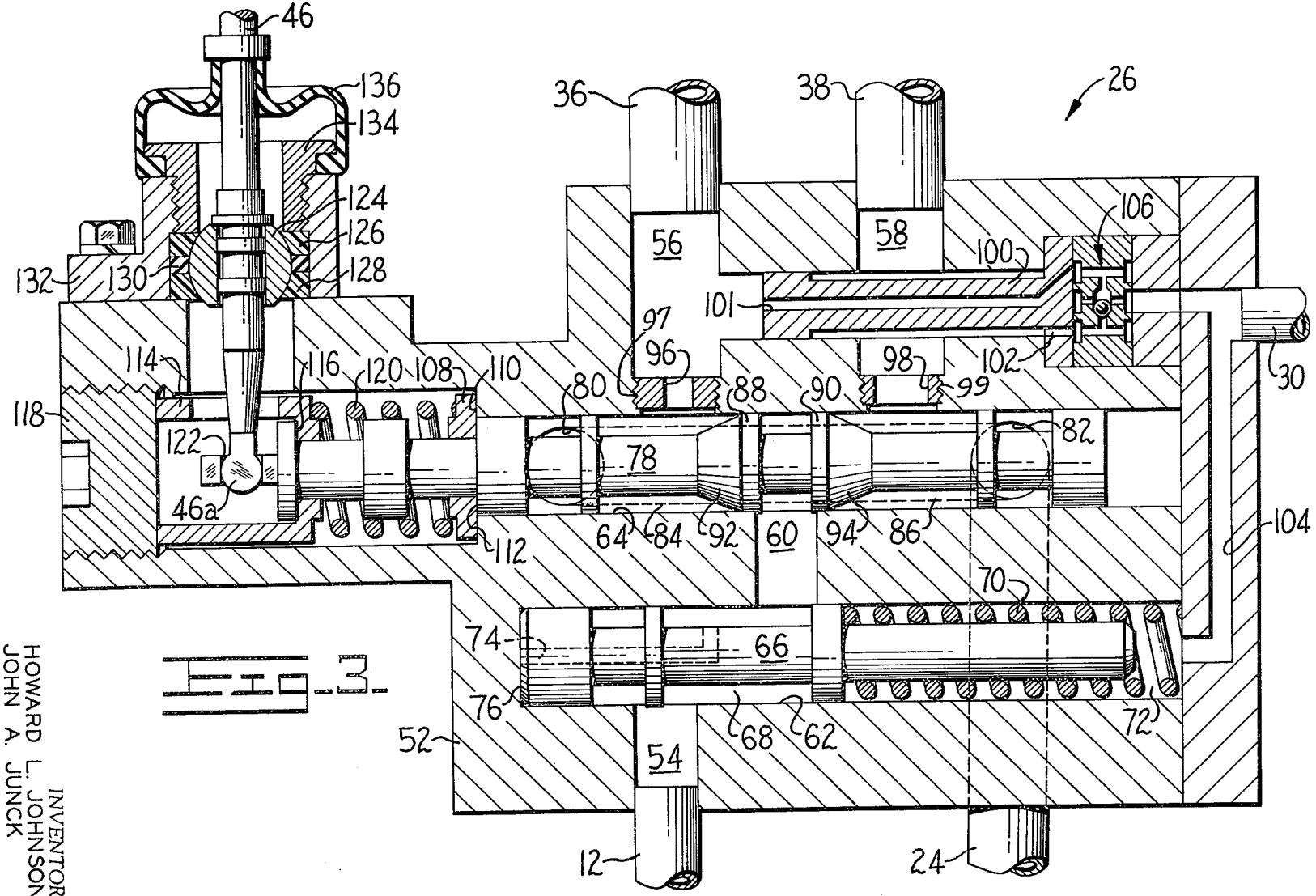
FIG. 3 is a sectional view of a control valve constructed in accordance with the present invention shown in the neutral position; and, FIG. 4 is a sectional view of the valve of FIG. 3 in the actuated position.

Referring now to FIG. 3, there is illustrated a cross-sectional view of the control valve 26 in the neutral position. The main control valve comprises a housing 52 having an inlet passage 54 and a pair of motor control outlet passages 56 and 58 with communications therebetween provided by a passage 60 and a pair of parallel bores 62 and 64 intersecting the passages. A pressure compensated flow control valve spool 66 is disposed in the cylindrical bore 62 and is operative in response to load pressure and pump pressure to control the flow of fluid between the inlet passage 54 and passage 60 to the main control spool. The spool 66 is provided with a groove 68 for providing communication between passages 54 and 60. A spring 70, together with fluid pressure in chamber 72, operates to bias or move the spool 66 to the leftward position, as illustrated in FIG. 3, for full communication between passages 54 and 60. A passageway 74 in spool 66 is operative to communicate fluid from the groove 68 to chamber 76 at the left end of spool 66.

A main control spool 78 is reciprocally mounted in cylindrical bore 64 and is responsive to control the flow of fluid between passage 60 and passages 56 and 58 and exhaust ports 80 and 82. The valve spool 78 is provided with a pair of grooves 84 and 86 for providing communication between passage 60 and control passages 56 and 58. The grooves 84 and 86 are separated by a pair of lands 88 and 90 having sloping faces 92 and 94 respectively, for assisting in modulation of the fluid flow. The motor control passages 56 and 58 are each provided with restricting means such as orifices 96 and 98 which are proportional to certain parameters such as the piston area served by that motor control port to obtain a desired rate of movement of the motor. For example, the head end of a piston normally has a cross sectional area equivalent to the cross sectional area of the cylinder. The rod end of the piston, on the other hand, has an area that is reduced by the cross sectional area of the rod itself. The orifices 96 and 98 can therefore be made responsive in conjunction with the control valve means to provide a flow that will produce the same rate of movement of the motor in either direction of movement for a given setting of the control valve.

The orifices 96 and 98 may be fixed in the housing and sized simply by drilling and/or reaming the opening between bore 64 and outlet ports 56 and 58. However, a more versatile construction is provided, as illustrated, wherein the orifices are formed in removable inserts which are attached as by threads 97 and 99 within the bores forming ports 56 and 58. This construction permits the economic construction and stocking of a single size valve body which can be readily modified to meet various flow control requirements. The flow rates can be modified by selecting an insert that will provide the desired flow rates.

Means comprising a plug 100 having passages 101 and 102 are provided for communicating load pressure from the motor 34 and by way of conduit 30 to the pressure compensating means to the variable pressure pump 10. A shuttle valve 106 is responsive to provide communication, or control the communications between the pressurized one of passages 56 or 58 and the respective pressure responsive means.

The main control valve is provided with centering means which is effective to control the lands or position the lands 88 and 90 directly over the passage 60. The centering means comprises a split washer or collar 108 mounted on a reduced diameter of the spool 78 and the engaging shoulders 110 of housing 52 and a shoulder 112 on spool 78. A split collar or sleeve 114 mounted on spool 78 is adapted to engage shoulders 116 on spool 78 and an adjustable plug 118 adjustably threaded into housing 52. A spring 120 is compressed between the washer or collar 108 and the sleeve 114 to bias them into engagement respectively with the shoulders 110, 116 and the plug 118. Thus, with this arrangement, the center position of spool 78 is determined by the stop position established by the shoulder 110, and permits spool play to be eliminated by the adjusting plug 118. With this arrangement a large degree of the accuracy normally required in machining can be eleminated.

Movement of the spool 78 is controlled by a lever assembly which comprises a lever 46 pivotally supported in the bracket 132 and having a lower end 46*a* fitted into a hole in yoke 122 for operative connection with the spool 78. The lever 46 is pivotally mounted in the housing or on the housing by means of a sphere or ball means 124 attached to the lever. The sphere is mounted in a suitable bearing arrangement comprising a pair of bearing rings 126 and 128 formed of a suitable material such as a plastic, and having a suitable seal in the form of an O-ring 130 positioned therebetween. The bearing rings 126 and 128 are held in place therebetween. The bearing rings 126 and 128 are held in place by a bracket 132 and an adjustable plug 134 so that the bearing rings can be adjusted in tightness so that the ball 124 can be adjusted to have no perceptible friction drag while being rotated, and at the same time, will have no lateral or axial movement. This arrangement provides an excellent seal to shut out the atmosphere and at the same time provides a low frictional pivot for the lever 46. A suitable elastic boot 136 covers the opening around lever 46 in a conventional manner.

Operation

Figure 4:
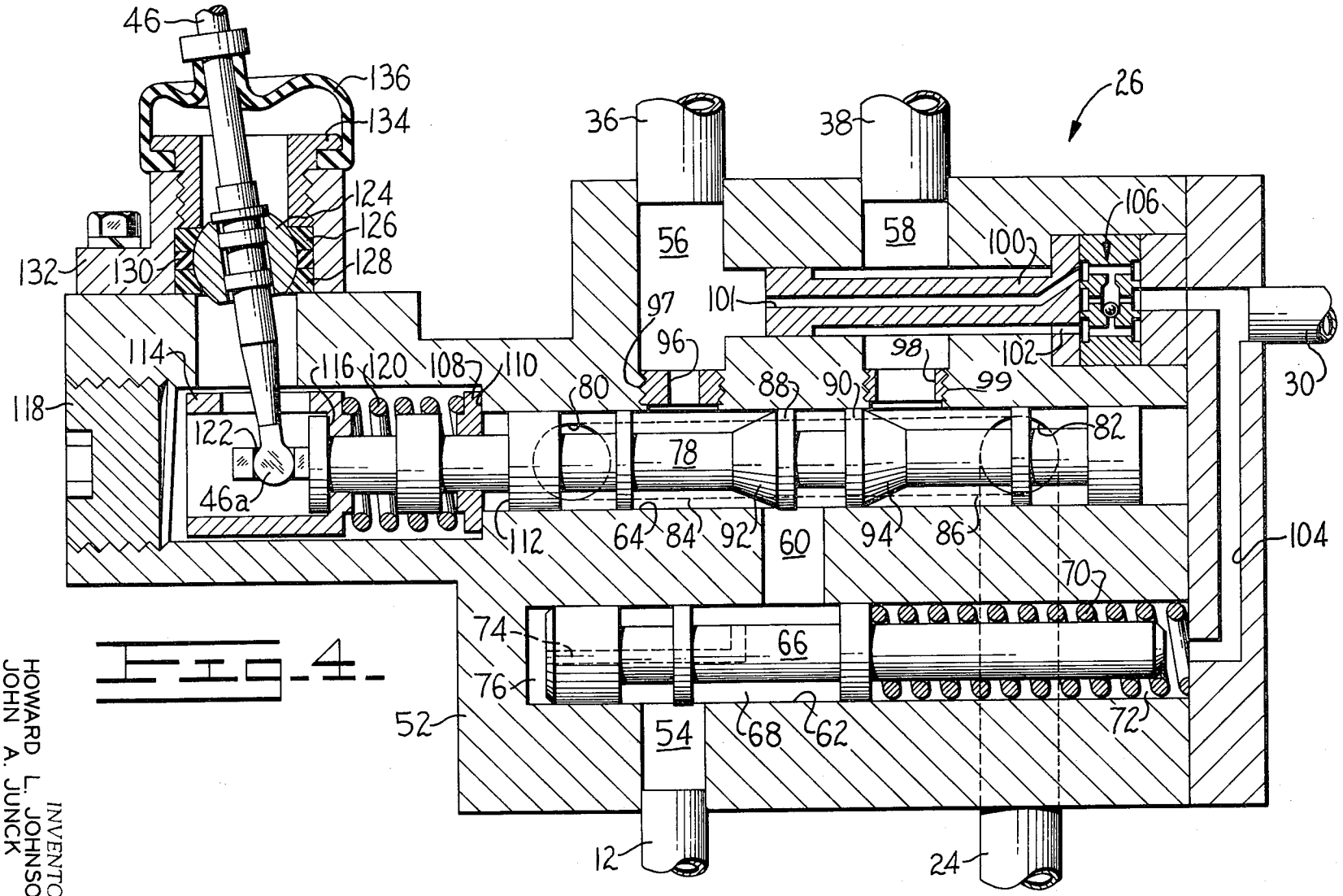

When the control spool 78 is shifted to the right, as illustrated in FIG. 4, the inlet passage 54 is then communicated by way of passage 60 and groove 84 of spool 78 with the orifice 96 and motor control passage 56. Fluid is thus directed to the lock valve 40 which is then responsive to permit fluid to be directed through conduit 42 to the implement cylinder or motor 34. The passage 56 also communicates with the passage 101 and shuttle valve 106 to communicate with passage 104 to chamber 72 and with the conduit 30 to the compensating mechanism of the pump 10. As the pressure in the passage 56 increases under the load imposed on the implement motor, the pressure in chamber 72, as well as spring 70, imposes a force to force spool 66 to the left. At the same time, pressure buildup in passages 60 and 68 will be communicated by passage 74 to chamber 76 to force the spool 66 to the right and achieve a balance between the pressures in the two chambers 72 and 76. As the pressure becomes balanced, spool 66 will move to a position so that the proper amount of fluid will be metered from supply line or inlet 54 by way of passage or groove 68 to passage 60 in a conventional pressure compensating manner.

The spring force acting on the spool 66 in conjunction with the effective orifice becomes or determines the flow to the passage 56. The effective orifice is defined as the combined result of the three fluid resistances in series, which consist of: (1) the orifice created when the land 88 moves to the right and partially uncovers passage 60; (2) the orifice created when the taper diameter 92 of spool 78, in combination with the edge of passage 60, chokes the flow exiting from the passage 60; and, (3) the fixed orifice 96.

A judicious selection of spring force and the combination of sizes for these three components of the effective orifice provides a control valve which will have a wide range of flow rates so that a mere sizing of these factors can provide a valve having a desired flow rate. Thus, a careful selection of the size for any particular valve, in accordance with this present invention, can provide a group of control valves having a wide range of flow rates and metering characteristics to meet specific needs with minimum differences in construction.

When fluid is being introduced into one end of the cylinder by way of passage 56, fluid is also being expelled from the other end of the cylinder by way of passage 58, orifice 98, and the annular groove 86 into the exhaust passage 82. The fluid from the exhaust passages of the many valves in the bank flows to a common manifold and then returns to the tank. Shifting of the valve in a reverse direction, that is, to the left, as viewed in FIG. 4, will reverse the above flow conditions.

It will be noted that the orifices 96 and 98 vary considerably in size. In the case shown, the sizes are different so that the resulting flow rates are made proportional to the rod end area and the head end area respectively of the implement cylinder. In doing so, the speed of actuation of the cylinder will be the same for each direction of movement. Similarly, each cylinder on the machine may have equal speeds in each direction as required. Similarly, this construction can be used to provide selectively different speeds in the different directions of operation of the motor. The present invention provides a means of construction for valves so that when a machine requires numerous cylinders of widely varying sizes, each cylinder may be assigned a valve with individual flow rates to provide optimum implement speeds. This may be accomplished by the same basic valve body and unit. For example, a wheel lean cylinder may operate at optimum speed at 2 gallons per minute simultaneously with a blade cylinder at its optimum speed at 15 gallons per minute without interaction between the two cylinders taking place. Furthermore, this flow rate can be accomplished by a pair of valves having this same basic component with only slight, inexpensive modifications carried out in the valve body itself or in the components going into the makeup of the valve. It should also be observed that the actuator described in combination with other features of the valve is constructed symetrically about a single plane. This provides a valve of narrow proportions so that a large number of units may be stacked together in a confined space.

Thus, it can be seen from the above description that I have provided a valve construction readily adaptable to numerous flow characteristics simply by carefully selecting numerous components to make the effective orifice of the control valve system. While this invention has been described with respect to a specific embodiment, it is to be understood that numerous changes or modifications may be made in the structure and arrangement as illustrated, without departing from the spirit and scope of the invention as defined in the appended claims.

We claim:

1. The combination of a control valve and a double acting hydraulic motor including a housing having a cylindrical chamber divided by a piston and rod assembly into a head end and a rod end having different fluid volumes, said valve comprising:

a valve body having an inlet passage and a pair of motor control passages one of said motor control passages connected to the head end of said motor and the other of said motor control passages connected to the rod end of said double acting motor;

a cylindrical bore in said housing communicating with said inlet passage and said motor control passage;

a valve spool reciprocably mounted in said bore and movable from a neutral position for controlling the flow of fluid between said inlet passage and said motor control passages; and, restricting means in the one of said control passages connected to the rod end of said motor for fixing the size of said one passage in relation to the size of said other passage to the same proportion that the volume of the rod end of said motor bears to the head end of said motor proportioning the flow of fluid to said motor through said control passages for thereby providing the same velocity movement of said motor in either direction.

2. The invention of claim 1 wherein said valve element is a spool having tapered lands defining conical sections extending outward from the center of said spool.

3. The invention of claim 1 comprising means including a spring and sleeve embracing one end of said spool and threaded plug means mounted in one end of said bore and engaging said sleeve for adjustably centering said valve element.

4. The invention of claim 1 comprising an actuating lever pivotally mounted in said housing and operatively connected to operate said valve element;

said pivotal mounting comprising a spherical section carried by said lever and having means defining a fulcrum mounted in said housing and adjustably embracing said spherical section.

5. The invention of claim 1 wherein said restricting means comprises an orifice in each of said control passages.

6. The valve of claim 1 comprising pressure responsive valve means disposed in said inlet passage prior to intersection thereof with said slidable valve element for controlling the flow of inlet fluid to said valve element.

7. The valve of claim 6 wherein said pressure responsive valve means is responsive to pressure in a selected one of said control passages to control said fluid flow.

8. The invention of claim 5 wherein said orifices are removable.

9. The invention of claim 5 wherein said orifices are formed in removable inserts threadably attached in said control passages.

* * * * *